US006678960B2

(12) United States Patent
Williams

(10) Patent No.: US 6,678,960 B2
(45) Date of Patent: Jan. 20, 2004

(54) UNDERCUT SAW WITH CENTRAL HEIGHT ADJUSTMENT

(76) Inventor: Dan Williams, 26955 Corte Cristal, Temecula, CA (US) 92590

( * ) Notice: Subject to any disclaimer, the term of this patent is extended or adjusted under 35 U.S.C. 154(b) by 0 days.

(21) Appl. No.: 10/094,026

(22) Filed: Mar. 6, 2002

(65) Prior Publication Data

US 2002/0166245 A1 Nov. 14, 2002

Related U.S. Application Data

(63) Continuation-in-part of application No. 09/852,170, filed on May 10, 2001, now Pat. No. 6,588,111.

(51) Int. Cl.[7] ..... B27B 9/02

(52) U.S. Cl. ..... 30/391; 30/296; 30/373; 30/388

(58) Field of Search ..... 30/388, 389, 390, 30/391, 373, 276, 124; 144/136.95; 409/182

(56) References Cited

U.S. PATENT DOCUMENTS 2,610,658 A * 9/1952 Koeling
4,993,243 A * 2/1991 Guinn ..... 30/390
5,088,865 A * 2/1992 Beth et al. ..... 409/182
5,327,649 A * 7/1994 Skinner ..... 30/124
5,784,789 A * 7/1998 Vargas ..... 30/388
5,853,274 A * 12/1998 Coffey et al. ..... 409/182
5,974,674 A * 11/1999 Kelly ..... 30/391

* cited by examiner

*Primary Examiner*—Hwei-Siu Payer
(74) *Attorney, Agent, or Firm*—Calif Tervo

(57) ABSTRACT

An undercut saw (10) having a central axis (11) generally comprises a cutting assembly (20) and a base (60). Cutting assembly (20) comprises case (30) housing electric motor (24) driving blade (50). Base (60), supporting cutting assembly (20) above a support surface, comprises cylindrical sleeve (63), supporting case (30) such that central axis (11) is vertical, and shroud (61) terminating in foot (98) for resting on a support surface. Case (30) and sleeve (63) are cooperatively adapted such that case (30) may be selectively moved vertically within sleeve (63) and retained in the selected position so as to adjust the height of blade (50) relative to foot (98). Vacuum attachment (100), immediately adjacent cutting area (53) to maximize collection, vacuums cuttings from blade cavity (97). Blade guard (132) rotates to an extended position covering cutting area (56) of blade (50) so as to include cutting area (56) in blade cavity (97). Wall guide (142), selectively positionable to align blade (50) with a workpiece, limits cut depth of blade (50).

17 Claims, 4 Drawing Sheets

FIG. 2
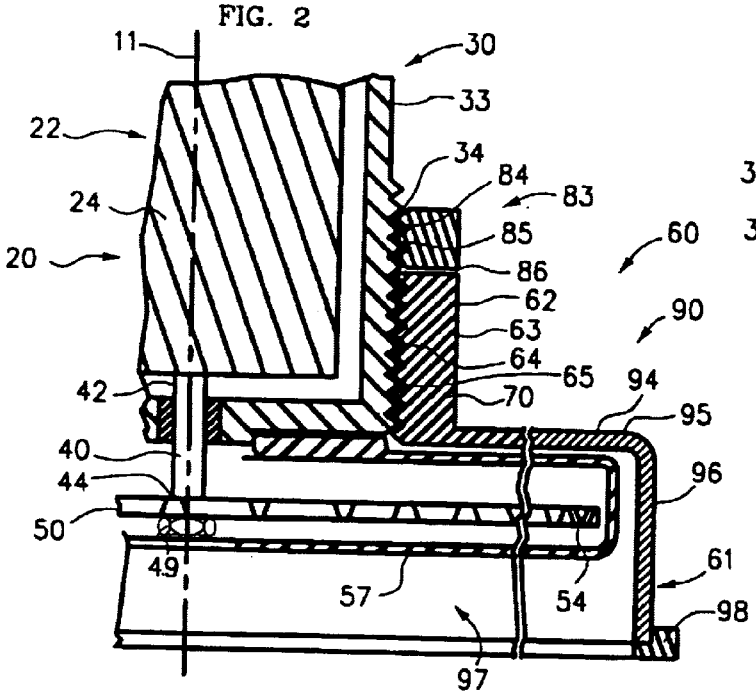
FIG. 6
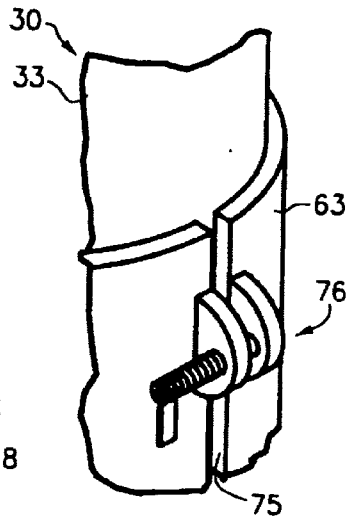
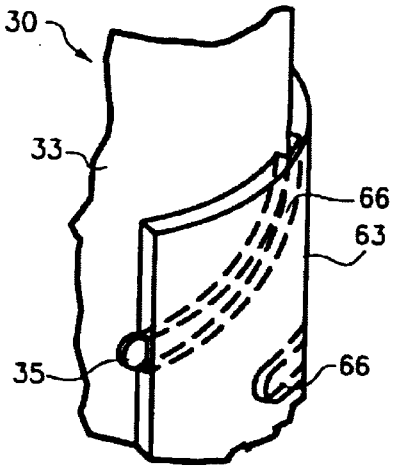
FIG. 3
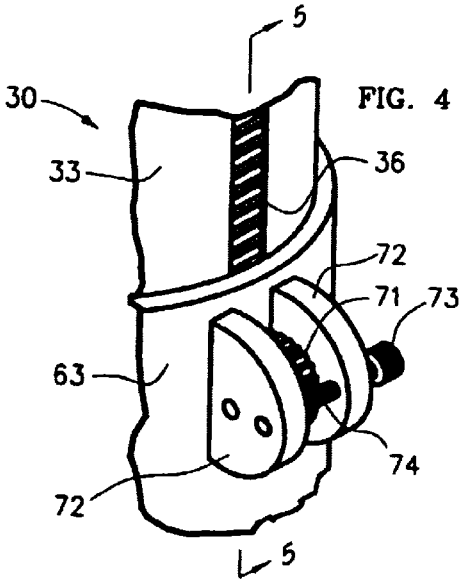
FIG. 4
FIG. 7
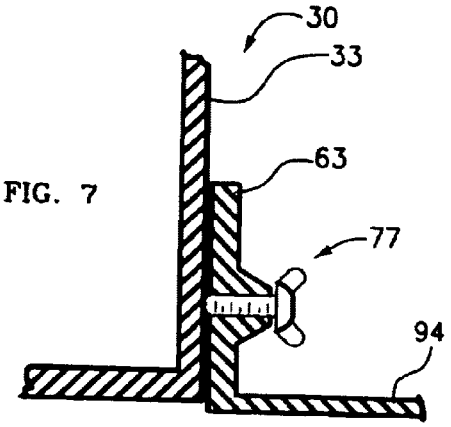
FIG. 5
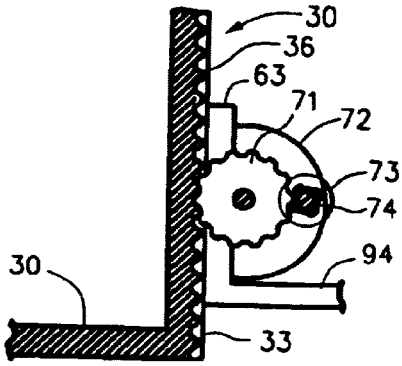

FIG. 10
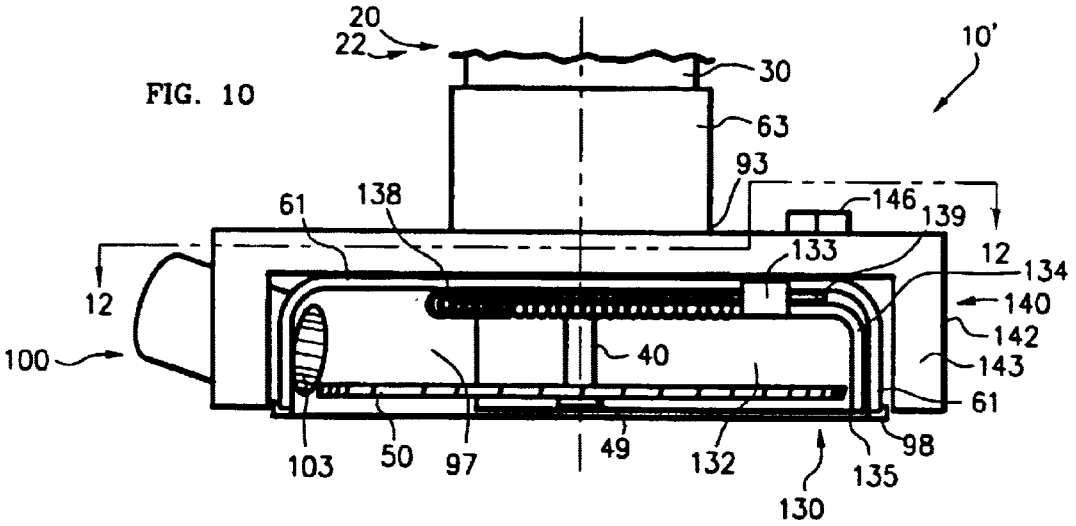
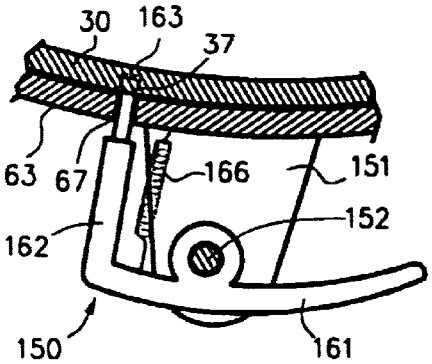
FIG. 9
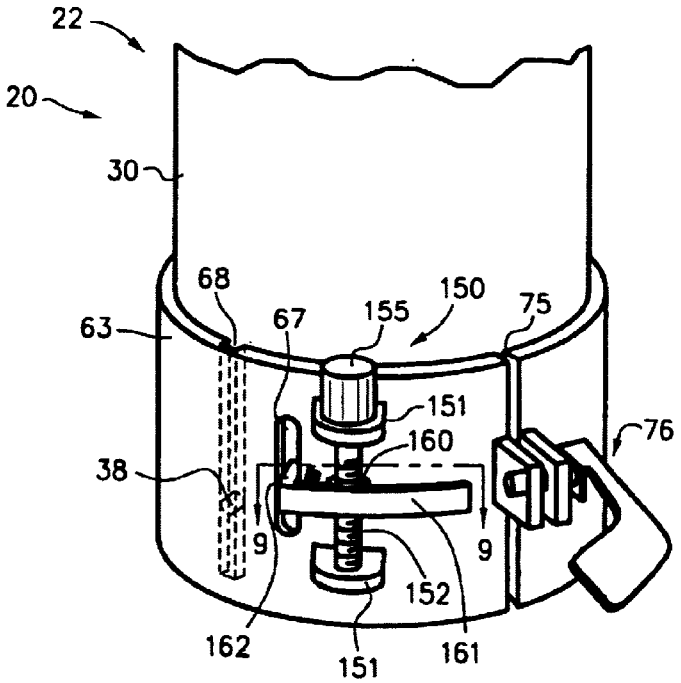
FIG. 8

FIG. 11
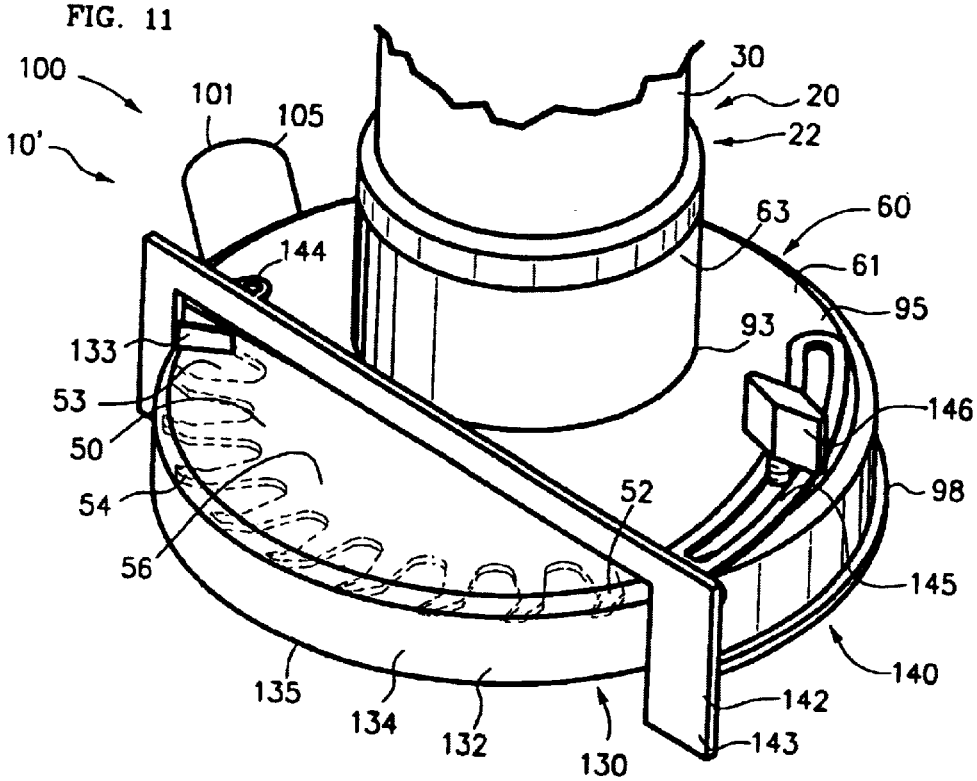
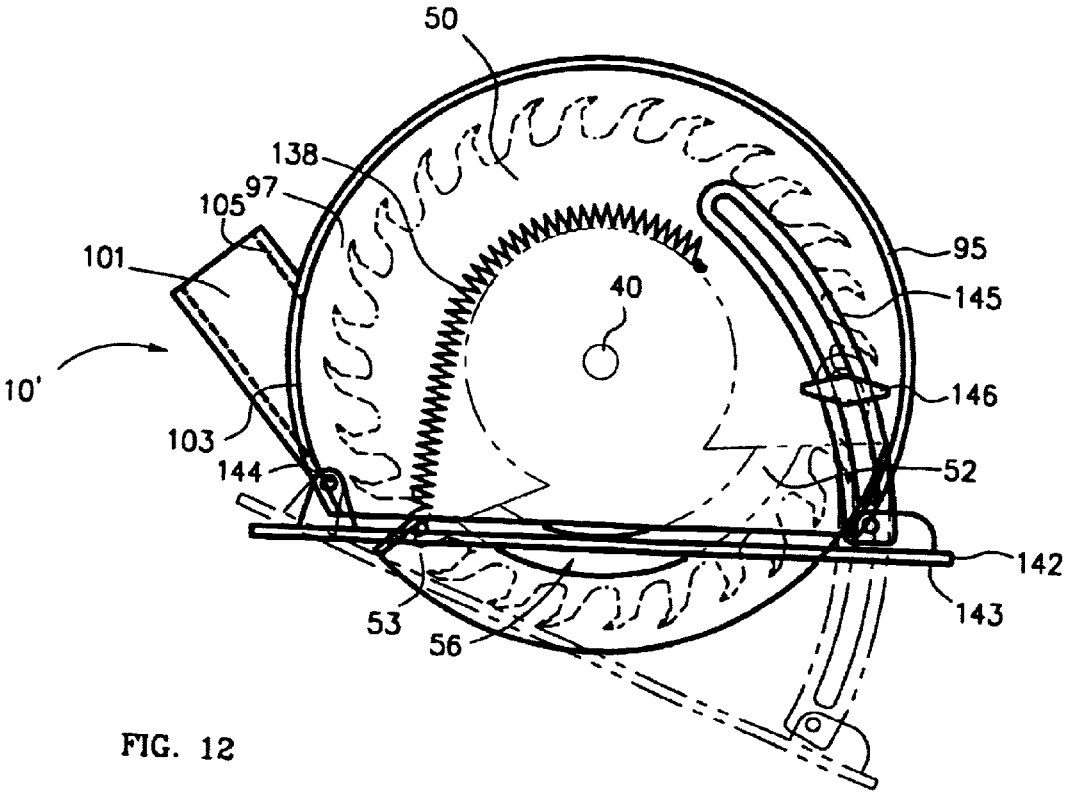
FIG. 12

UNDERCUT SAW WITH CENTRAL HEIGHT ADJUSTMENT

CROSS-REFERENCE TO RELATED APPLICATIONS

This application is a continuation-in-part of application Ser. No. 09/852,170, filed May 10, 2001 now U.S. Pat. No. 6,588,111.

FIELD OF THE INVENTION

This invention relates in general to undercut saws, and more specifically involves an undercut saw with a centrally located height adjustment mechanism.

BACKGROUND OF THE INVENTION

Undercut saws or flush-cutting saws are used to undercut doors and baseboards, typically by about 0.25 inches to 1.75 inches, to provide sufficient space for floor coverings to fit underneath.

Conventional undercut saws use a cutting assembly including an electric rotary motor driving a shaft rotating a flat, circular cutting blade in a horizontal plane. The cutting assembly is held above a guide surface, such as a floor, by a base that provides a large stable skid surface for sliding the saw along the floor. The base includes an inner portion attached to the cutting assembly, horizontal portion extending radially outward therefrom and past the blade circumference, and an outer generally vertical leg portion extending down from the periphery of the horizontal portion to rest on the floor.

The blade is adjusted vertically by adjusting the height of the leg of the base. Typically, the leg comprises includes inner and outer mating vertically telescopic collars. The relative position of the collars is determined in a manner such as the inner collar having a plurality of spaced protruding studs, the outer collar having slots for receiving the studs, and a plurality of wing nuts, each attached to a stud for clamping the collars together.

This peripheral adjustment approach has several shortcomings. Notably, it is slow because several fasteners require adjustment. More importantly, using the peripheral adjustments, it is difficult to adjust the height so that the blade is level. The blade is only level if each of the peripheral studs and wing nuts, are at the same height. This is not quickly and easily accomplished.

It is desirable that an undercut saw include a vacuum attachment to capture cuttings. Another shortcoming of peripheral height adjustment is that a vacuum cannot be attached to the periphery of the blade shroud because the vertical portion of the shroud must adjust.

At least one attempt has been made to provide central height adjustment using an angled drive, but this resulted in an awkward, unbalanced device requiring a large triangular base.

Therefore, there has been a need for an undercut saw with improved mechanism that quickly and accurately adjusts the cutting height while maintaining the blade level and that does not otherwise detract from the ergonomics of the saw.

SUMMARY OF THE INVENTION

This invention is an undercut saw having a central axis, generally comprising a cutting assembly and a base. The cutting assembly comprises a case that houses an electric motor that drives a shaft upon which a saw blade is mounted to rotate in a plane perpendicular to the central axis. The base supports the cutting assembly above a support surface and comprises a cylindrical sleeve horizontally surrounding the motor case and supporting the case such that the central axis is vertical, and a blade shroud extending radially outward to define a blade cavity covering the majority of the blade except for a cutting area. The cutting assembly and base include cooperative height adjustment means for selectively moving the case vertically within the base so as to adjust the height of said blade relative to the support surface.

A passageway connected to the blade cavity is adapted for attachment to a vacuum device for vacuuming blade cuttings from the blade cavity.

A blade guard assembly is rotatable between a retracted position adjacent said shroud and an extended position covering the cutting area of the blade so as to include the cutting area in the blade cavity.

A wall guide is selectively positionable to align the blade with a workpiece and limit the depth of blade cut.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 2 is a partial, vertical, cross-sectional view of the saw of FIG. 1 taken on the threaded interface between motor housing and base sleeve.

FIG. 3 is a partial perspective view of a pin and slot height adjustment means.

FIG. 4 is partial perspective view of a rack and pinion height adjusting means.

FIG. 5 is a sectional view taken on line 5—5 of FIG. 4.

FIG. 6 is a partial perspective view of a clamping height adjustment means.

FIG. 7 is a partial cross-sectional view of a set screw height adjustment means, or, alternately, a braking or stopping means.

FIG. 8 is a partially cut-away perspective view of a jack screw height adjustment means.

FIG. 9 is an enlarged cross-sectional view of the jack screw height adjustment means taken on line 9—9 of FIG. 8.

FIG. 10 is a partially cut-away perspective view of an alternative embodiment of the undercut saw of the invention.

FIG. 11 is a front elevation view of the lower portion of the saw of FIG. 10.

FIG. 12 is a reduced horizontal cross-sectional view taken on line 12—12 of FIG. 10.

DETAILED DESCRIPTION OF THE INVENTION

Figure 1:
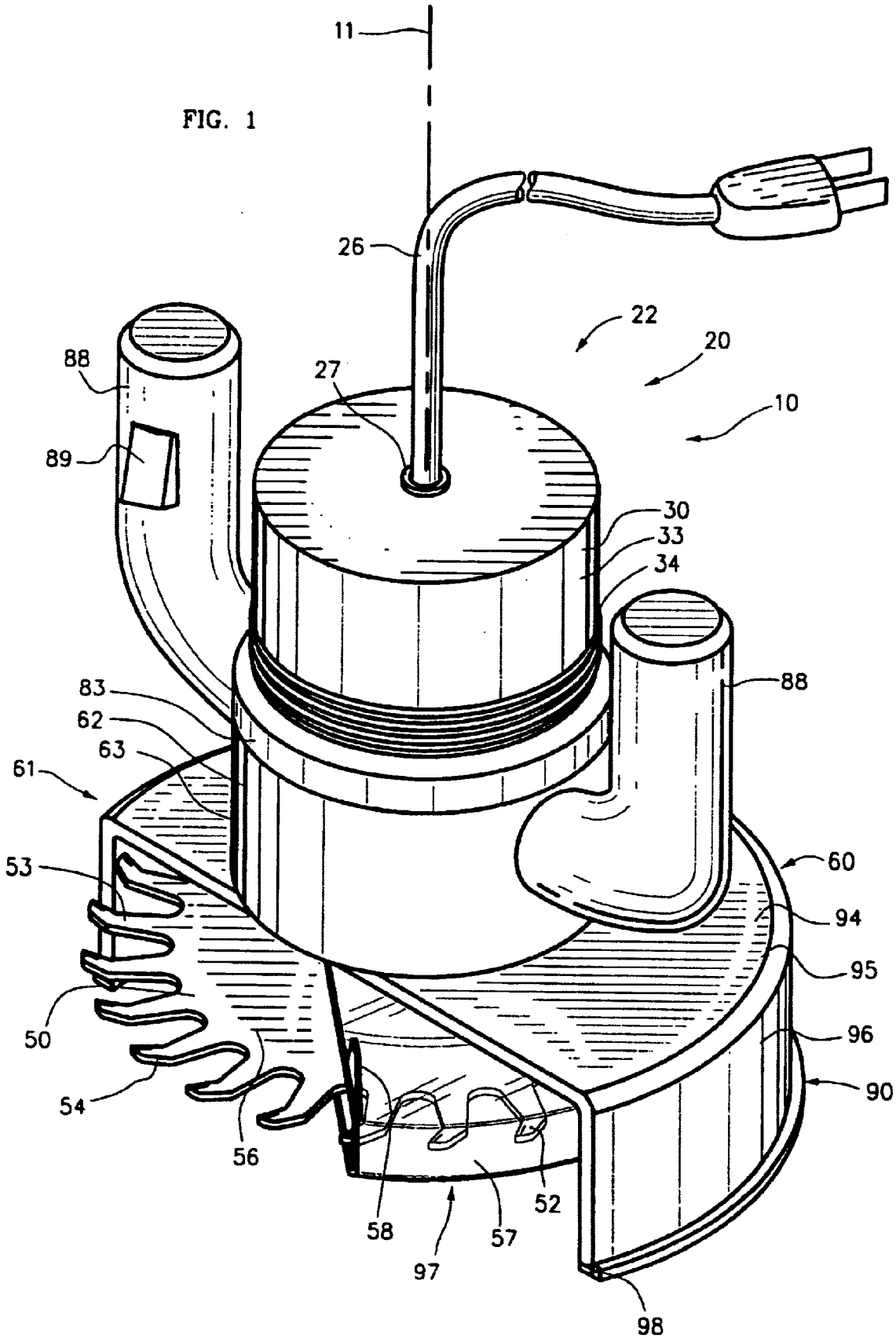
FIG. 1 is a top-front perspective view of a preferred embodiment of the undercut saw of the invention.

With reference now to the drawings, FIG. 1 is a top-front perspective view of a preferred embodiment of the undercut saw 10 of the invention, and FIG. 2 is a partial, vertical, cross-sectional view of the saw 10 of FIG. 1 taken on the threaded interface between motor case 30 and base sleeve 63.

Undercut saw 10 has a central axis 11 and, in general, comprises a cutting assembly 20 and a base 60 for supporting cutting assembly 20.

Cutting assembly 20 comprises a motor assembly 22, a shaft 40, and a cutting tool, such as blade 50. Motor assembly 22 includes an electric motor 24 mounted within case 30. Case 30 has an outer surface 33, which is typically cylindrical. Electric motor 24 rotates about central axis 11 and turns shaft 40 about central axis 11. Shaft 40 has an upper end 42 connected to and driven by motor 24 and a lower end 44.

Blade 50 is typically a thin, planar cutting blade, such as a steel saw blade or a grinding disk, and is attached to lower end 44 of shaft 40, such as by mounting bolt 49, so as to rotate with shaft 40 about central axis 11 in a plane perpendicular to central axis 11. Blade 50 extends radially outward past motor case 30 and terminates radially in a circumferential cutting edge 54. Blade 50 must extend sufficiently radially outward past motor assembly 22 or inner portion 62 of base 60 so as to be able to undercut a door or counter. A typical blade 50 has a diameter of eight inches. When blade 50 is making the undercut, motor assembly 22 or inner portion 62 of base 60 contacts the door or counter surface. The radial extension of blade 50 past motor assembly 22 or inner portion 62 of base 60 is preferably in the range of two to four and a half inches.

Base 60 supports cutting assembly 20 above a support surface. Base 60 comprises an inner portion 62 including a sleeve 63 and an outer portion 90 including a horizontal portion 94 and a generally vertical leg portion 96 terminating in a foot 98 for resting on a support surface, such as a floor. When resting on a support surface, base 60 supports case 30 such that central axis 11 is vertical.

Sleeve 63 horizontally surrounds motor case 30. Sleeve 63 includes an inner surface 64 and an outer surface 70. Typically, sleeve 63 is cylindrical.

Horizontal portion 94 is connected to inner portion 62, such as to lower end of sleeve 63, and extends radially outward therefrom so as to have a periphery 95 radially outward past the largest radius of blade 50 so as to cover blade 50 except for an exposed cutting area 56 on the front of saw 10. Exposed cutting area 56 has a first end 52 where, due to rotation of blade 50, cutting edge 54 of blade 50 exits cavity 97 and a second end 53 where cutting edge 54 enters cavity 97. Thus, at second end 53, cutting edge 54 of blade 50 is just exiting the workpiece and cutting edge 54 is loaded with fresh cuttings, such as sawdust or swarf.

Leg portion 96 extends down from periphery 95 of horizontal portion 94. Foot 98 slides over a support surface and may be made of metal, rigid plastic, or other non-marring material.

Preferably, a blade safety shield 57 is attached to case 30 as is well known in the art and moves vertically with vertical adjustment of motor assembly 22. Safety shield 57 is biased, such as by a spring, to cover cutting area 56 of blade 50 when blade 50 is not in contact with a workpiece. Safety shield 57 is pushed to a retracted position under horizontal portion 94 upon encounter with the workpiece or by the user using retractor 58.

A pair of handles 88 are attached, such as to opposite sides of sleeve 63 for holding by the user for manipulating saw 10. A trigger 89 serves as an on/off switch and may also control motor speed.

Case 30 and sleeve 63 include cooperative height adjustment means such that case 30 may be selectively moved vertically within sleeve 63 and retained in the selected position so as to adjust the height of blade 50 relative to foot 98.

In the preferred embodiments of FIGS. 1, 2, and 3, cooperative height adjustment means includes cooperating screw means for moving case 30 vertically in sleeve 63 upon rotation of case 30 relative to sleeve 63 about central axis 11.

A line cord 26 provides electrical power to motor 24. In the embodiments that adjust by turning case 30, line cord 26 preferably departs motor assembly 22 along central axis 11, such as through grommet 27 in case 30. Alternatively, motor 24 could be powered by some other means, such as by compressed air, and the hose supplying compressed air would preferably depart motor assembly 22 along central axis 11.

In FIGS. 1 and 2, the screw means comprises external helical threads 34 on outer surface 33 of case 30 and cooperating internal threads 65 on inner side 64 of sleeve 63. Locking means, such as locking ring 83, securely retains case 30 in the selected position. Locking ring 83 surrounds case 30 and includes an inner surface 84, including inner threads 85 cooperating with external threads 34 of case 30 so as to move vertically relative to case 30 with rotation of ring 83, and a bottom surface 86 for bearing against the top of sleeve 63 in a locking position wherein rotation of case 30 relative to sleeve 63 is prevented. Other locking means are contemplated, such as a set screw or clamping brake.

FIG. 3 is a partial perspective view of an alternate screw-type adjustment means using cooperating pin 35 and helical slot or channel 66. In the embodiment shown, a plurality of protruding pins 35 would be horizontally circumferentially spaced on outer surface 33 of case 30 and a plurality of cooperating helical channels 66 are disposed in inner surface 64 of sleeve 63. A single pin 35 and channel 66 could be used, and the disposition of pins and channels could be reversed. A plurality of channels 66 is preferred because they supply more even vertical forces for even, non-binding and level vertical movement, as is true with the screw threads of FIGS. 1 and 2. A locking mechanism, not shown, such as a brake or set screw, retains the height at the selected position. Pins 35 and channels 66 generally provide for faster height adjustment than threads.

FIG. 4 is a partial perspective view of a rack and pinion height adjusting means. FIG. 5 is a sectional view taken on line 5—5 of FIG. 4. Outer surface 33 of case 30 includes a vertical rack 36 recessed therein. Sleeve 63 includes a pinion 71 supported by supports, such as ears 72, engaging rack 36 through a slot in sleeve 63 such that rotation of pinion 71 moves base 60 vertically. Rack and pinion height adjusting means includes drive knob 73 and drive/locking gear 74. Drive knob 73 is turned to move drive gear 74 for turning pinion 71. The gear ratio and friction in the drive locks pinion 71 from freely turning.

FIG. 6 is a partial perspective view of a clamping height adjustment means. Sleeve 63 includes a vertical slit 75. An adjustable clamp 76 adjusts the width of slit 75. Loosening clamp 76 allows sliding vertical adjustment of case 30 and tightening clamp 76 retains case 30 at the selected height.

FIG. 7 is a partial cross-sectional view of a set screw height adjustment means or, alternately a braking or stopping means. Case 30 of FIG. 7 is vertically slidable in sleeve 63, and sleeve 63 includes stop means, such as set screw 77 for selectively contacting case 30 for stopping case 30 from vertical movement. Alternatively, set screw 77 could be used as a braking or stopping means for the screw adjustments of FIGS. 1–3 interacting between sleeve 63 and case 30 and operating between a first position wherein case 30 can rotate relative to sleeve 63 and a second position resisting relative rotation and holding case 30 at the selected height. Other braking or stopping means are contemplated, such as a clamping brake.

FIG. 8 is a partially cut-away perspective view of a jack screw assembly 150 used as cooperative height adjustment means. FIG. 9 is an enlarged cross-sectional view of jack screw assembly 150 taken on line 9—9 of FIG. 8. Sleeve 63 includes a vertical slit 75. An adjustable clamp 76 adjusts the width of slit 75. Loosening clamp 76 allows sliding vertical adjustment of case 30 and tightening clamp 76 retains case 30 at the selected height. Jack screw assembly 150 includes cooperative height adjustment means in case 30 and base 60. Screw 152 is mounted, such as on bosses 155, on sleeve 63 so as to be rotated by hand by knob 151. Nut 160, threaded on screw 152, moves up and down as screw 152 is turned. Nut 160 includes teeter 161 with arm 162 having an inner end 163. Sleeve 63 includes a through-slot 67 for passage of arm 162. Teeter 161 is movable between an engaged position, shown, wherein inner end 163 of arm 162 is disposed through slot 67 and engages a cavity 37 in case 30 such that the height of case 30 is determined by the nut 160, and a non-engaged position wherein inner end 163 is not engaged in cavity 37. Biasing means, such as spring 166, biases teeter 161 to the engaged position. If case 30 is otherwise free to move, with jack screw engaged, turning knob 151 will move nut 160 and case 30 vertically for height adjustment.

Case 30 and sleeve 63 include cooperative alignment means, such as pin 38 and elongate channel 68 for preventing rotation of case 30 in sleeve 63 and assuring alignment of arm 162 and cavity 37.

FIG. 10 is a partially cut-away perspective view of an alternative embodiment 10' of the undercut saw of the invention. FIG. 11 is a front elevation view of the lower portion of saw 10' of FIG. 10. FIG. 12 is a horizontal cross-sectional view taken on line 12—12 of FIG. 10.

Undercut saw 10' is similar to saw 10 above, having a central axis 11 and generally comprising similar components except as described below. Base 60 supports cutting assembly 20 above a support surface such that central axis 11 is normal to the support surface. Base 60 comprises a blade shroud 61 including an inner end 93, such as sleeve 63, supporting motor assembly 22, such as case 30 and an outer end, such as foot 98, for resting on the support surface. Base 60 extends radially outward from inner end 93 and has a periphery 95 past the circumference, i.e., cutting edge 54, of blade 50 so as to cover the majority of blade 50 except for a cutting area 56 and so as define a blade cavity 97.

A vacuum attachment means 100 includes a passage 101 in base 60 in fluid communication with blade cavity 97 including an inner end 103 opening on blade cavity 97 and an outer end 105 adapted for attachment to a vacuum device (not shown) for vacuuming sawdust or swarf from blade cavity 97. Inner end 103 is adjacent second end 53 of exposed cutting area 56 so as to vacuum fresh sawdust or swarf from cutting edge 54 of blade 50 immediately upon exiting the workpiece.

Shroud 61 further includes a blade guard assembly 130 including a blade guard 132 rotatably mounted to base 60 and rotatable between a retracted position adjacent shroud 61 as seen in FIG. 11 and an extended position as seen in FIGS. 10 and 12. In the extended position, guard 132 covers cutting area 56 of blade 50 so as to include cutting area 56 in blade cavity 97. Guard 132 includes a peripheral wall 134 having a lower end 135 disposed substantially near the support surface. Biasing means, such as spring 138 having one end connected to shroud 61 and the other end connected to guard 132, biases guard 132 toward the extended position. Guard 130 is pushed toward the retracted position upon encounter with the workpiece or by the user using retractor 133. Sealing means, such as felt 139 between guard 130 and shroud 61 prevents air passage therebetween so as to maximize the effectiveness of the vacuum.

A wall guide assembly 140 includes means, such as wall guide 142, defining a plane 143 adjacent cutting area 56 of blade 50 and normal to the plane of blade 50 for bearing against a workpiece being cut such that blade 50 remains normal to the plane of the workpiece. A pivot connector 144 pivotally connects one end of wall guide 142 to shroud 61 adjacent second end 53 of exposed cutting area 56. Positioning means, such as swing arm 145 and screw 146, pivot wall guide 142 about pivot connector 144 such that blade 50 exits the cut at second end 53 of exposed cutting area 56 and such that plane 143 of wall guide 142 is selectively positioned so as to limit the depth of cut of blade 50. Wall guide 142 is pivoted at second end 53 of exposed cutting area 56 so as to remain relatively stationary there so that inner end 103 of vacuum attachment 100 collects dust at the nearest point of blade exit from the workpiece for maximum dust collection.

Having described the invention, it can be seen that it provides an undercut saw with superior height adjustment and vacuuming.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An undercut saw having a central axis; said saw comprising:

a cutting assembly comprising:
- a motor assembly including:
  - a case including:
    - an outer side; and
  - a motor mounted within said case and rotatable about the central axis;
- a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:
- a blade shroud including:
  - an inner end supporting said case;
  - an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity; and
  - a blade guard assembly including:
    - a blade guard rotatably mounted to said base and rotatable between a retracted position adjacent said shroud and exposing said blade and an extended position covering the cutting area of said blade so as to include the cutting area in the blade cavity; and scaling means between said guard and said base for preventing air passage therebetween, and a vacuum passage in said base in fluid communication with the blade cavity and adapted for attachment to a vacuum device for vacuuming blade cuttings from said blade cavity; wherein said case and said base include:

cooperative height adjustment means for selectively moving said case vertically within said base so as to adjust the height of said blade relative to the support surface.

2. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:

an inner portion including:

a sleeve supporting said case including:

an inner side; and an outer portion including:

an inner end connected to said inner portion and an outer end for resting on the support surface so as to overlie said blade except for an exposed cutting area; said exposed cutting area having a first end where said cutting edge of said blade exits said cavity and a second end where said cutting edge enters said cavity; and a wall guide attached to said base including:

means defining a plane adjacent the exposed cutting area of said blade and normal to the plane of said blade for bearing against a workpiece being cut for guiding said saw along a workpiece during cutting; said wall guide pivotly attached to said base about an axis adjacent said first end or said second end of said exposed cutting area; for selectively positioning said plane of said wall guide relative to said blade so as to limit the depth of blade cut; wherein said case and said base include:

cooperative height adjustment means for selectively moving said case vertically within said sleeve so as to adjust the height of said blade relative to the support surface.

3. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge;

a base for supporting said cutting assembly above a support surface such that the central axis is normal to the support surface; said base comprising:

an inner portion including:

a sleeve supporting said case including:

an inner side; and an outer portion including:

an inner end connected to said inner portion and an outer end for resting on the support surface so as to overlie said blade except for an exposed cutting area; said exposed cutting area having a first end where said cutting edge of said blade exits said cavity and a second end where said cutting edge enters said cavity; and a wall guide attached to said base including:

means defining a plane adjacent the exposed cutting area of said blade and normal to the plane of said blade for bearing against a workpiece being cut; said wall guide pivotable about an axis adjacent said second end of said exposed cutting area for selectively positioning said plane of said wall guide relative to said blade so as to limit the depth of blade cut; wherein said case and said base include:

cooperative height adjustment means for selectively moving said case vertically within said sleeve so as to adjust the height of said blade relative to the support surface.

4. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:

a blade shroud including:

an inner end supporting said case; and an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity; and a vacuum passage in said base in fluid communication with the blade cavity and adapted for attachment to a vacuum device for vacuuming blade cuttings from said blade cavity; and said case and said base include:

cooperative height adjustment means for selectively moving said case vertically within said base so as to adjust the height of said blade relative to the support surface.

5. The undercut saw of claim 4, wherein:

said vacuum passage is disposed through said periphery of said blade shroud.

6. The undercut saw of claim 4, said shroud further including:

a blade guard assembly including:

a blade guard rotatably mounted to said base and rotatable between a retracted position adjacent said shroud and exposing said blade for cutting such that said blade guard is not disposed between said cutting edge and said vacuum passage and an extended position covering the cutting area of said blade.

7. The undercut saw of claim 6, wherein said guard includes.

a top extending radially outward for covering said blade and lying adjacent said shroud in the retraced position; and a peripheral wall having a lower end disposed substantially near the support surface such that in the extended position the exposed cutting area of said blade covered by said blade guard is effectively included in the blade cavity.

8. An undercut saw having a central axis; said saw comprising:

a cutting assembly comprising:
a motor assembly including:
a case including:
an outer side; and
a motor mounted within said case and rotatable about the central axis;
a thin, planar cutting blade attached to said motor so as to rotate about the central axis and extending radially outward past said motor case and terminating radially in a circumferential cutting edge;

a base for supporting said cutting assembly above a support surface such that the central axis is normal to the support surface; said base comprising:
a blade shroud including:
an inner end supporting said case;
an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity; and
a vacuum passage in said base in fluid communication with the blade cavity and adapted for attachment to a vacuum device for vacuuming blade cuttings from said blade cavity; and a wall guide attached to said base including:
means defining a plane adjacent the cutting area of said blade and normal to the plane of said blade for bearing against a workpiece being cut; and
positioning means for selectively positioning said plane of said wall guide so as to limit the depth of blade cut; wherein said wall guide is pivotable about an axis adjacent said second end of said exposed cutting area: wherein said case and said base include:
cooperative height adjustment means for selectively moving said case vertically within said base so as to adjust the height of said blade relative to the support surface.

9. The undercut saw of claim 8, wherein:

said vacuum passage includes:
an inner end; said inner end opening on said blade cavity adjacent said second end of said exposed cutting area.

10. An undercut saw having a central axis; said saw comprising:

a cutting assembly comprising:
a motor assembly including:
a case including:
an outer side; and
a motor mounted within said case and rotatable about the central axis;
a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:
a blade shroud including:
an inner end supporting said case; and
an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity:
a vacuum passage in said base in fluid communication with the blade cavity and adapted for attachment to a vacuum device for vacuuming blade cuttings from said blade cavity, including an inner end opening on said blade cavity; wherein:

said case and said base include:
cooperative height adjustment means for selectively moving said case vertically within said base so as to adjust the height of said blade relative to the support surface; and said shroud further includes:
a blade guard assembly including:
a blade guard rotatably mounted to said base and rotatable between a retracted position adjacent said shroud such that said blade guard is not disposed between said cutting edge and said vacuum passage and exposing said blade and an extended position covering the exposed cutting area of said blade; said blade guard opening away from said inner opening of said vacuum passage.

11. The undercut saw of claim 10, wherein:

said vacuum passage includes:
an inner end opening on said blade cavity adjacent said second end of said exposed cutting area.

12. An undercut saw having a central axis; said saw comprising:

a cutting assembly comprising:
a motor assembly including:
a case including:
an outer side; and
a motor mounted within said case and rotatable about the central axis;
a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:
a blade shroud including:

an inner end supporting said case; and an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity:

a vacuum passage in said base in fluid communication with the blade cavity and adapted for attachment to a vacuum device for vacuuming blade cuttings from said blade cavity, including an inner end opening on said blade cavity; wherein:

said case and said base include:

cooperative height adjustment means for selectively moving said case vertically within said base so as to adjust the height of said blade relative to the support surface; and said shroud further includes:

a blade guard, assembly including:

a blade guard rotatably mounted to said base and rotatable between a retracted position adjacent said shroud and exposing said blade and an extended position covering the exposed cutting area of said blade so as to include the exposed cutting area of said blade in the blade cavity; said blade guard opening away from said inner opening of said vacuum passage; and further including:

sealing means between said guard and said base for preventing air passage therebetween.

13. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:

a blade shroud including:

an inner end supporting said case; and an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity:

a vacuum passage in said base in fluid communication with the blade cavity and adapted for attachment to a vacuum device for vacuuming blade cuttings from said blade cavity, including an inner end opening on said blade cavity; wherein:

said case and said base include:

cooperative height adjustment means for selectively moving said case vertically within said base so as to adjust the height of said blade relative to the support surface; and said shroud further includes:

a blade guard assembly including:

a blade guard including:

a peripheral wall having a lower end disposed substantially near the support surface; said blade guard rotatably mounted to said base and rotatable between a retracted position adjacent said shroud and exposing said blade and an extended position covering the exposed cutting area of said blade so as to include the exposed cutting area of said blade in the blade cavity; said blade guard opening away from said inner opening of said vacuum passage; and further including:

sealing means between said guard and said base for preventing air passage therebetween.

14. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge; and a base for supporting said cutting assembly above a support surface such that the central axis is normal to the support surface; said base comprising:

a blade shroud including:

an inner end supporting said case;

an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity; and a blade guard assembly including:

a blade guard rotatably mounted to said base and rotatable between a retracted position adjacent said shroud and exposing said blade and an extended position covering the exposed cutting area of said blade so as to include the exposed cutting area of said blade in the blade cavity; said blade guard including:

a top extending radially outward for covering said blade and lying adjacent said shroud in the retraced position; and a peripheral wall having a lower end disposed substantially near the support surface; and a vacuum passage in said base in fluid communication with the blade cavity and adapted for attachment to a vacuum device for vacuuming blade cuttings from said blade cavity; wherein said case and said base include:

cooperative height adjustment means for selectively moving said case vertically within said base so as to adjust the height of said blade relative to the support surface.

15. The undercut saw of claim 14 wherein, in the retracted position, said blade guard is not disposed between said cutting edge and said vacuum passage.

16. The undercut saw of claim 15 wherein:

said vacuum passage is disposed through said periphery of said blade shroud.

17. An undercut saw having a central axis; said saw comprising:

a cutting assembly comprising:

a motor assembly including:

a case including:

an outer side; and a motor mounted within said case and rotatable about the central axis;

a thin, planar cutting blade attached to said motor so as to rotate about the central axis and extending radially outward past said motor case and terminating radially in a circumferential cutting edge: and a base for supporting said cutting assembly above a support surface such that the central axis is normal to the support surface; said base comprising:

a blade shroud including:

an inner end supporting said case;

an outer end for resting on the support surface; said base extending radially outward from said inner end and having a periphery past the blade circumference such so as to cover the majority of said blade so as to define a blade cavity and an exposed cutting area; said exposed cutting area having a first end where said cutting edge of said blade exits said cavity and a second end where said cutting edge enters said cavity; and a blade guard assembly including:

a blade guard rotatably mounted to said base and rotatable between a retracted position adjacent said shroud and exposing said blade and an extended position covering the exposed cutting area of said blade so as to include the exposed cutting area of said blade in the blade cavity; said blade guard including:

a peripheral wall having a lower end disposed substantially near the support surface; and a vacuum passage in said base in fluid communication with the blade cavity and adapted for attachment to a vacuum device for vacuuming blade cuttings from said blade cavity; wherein said case and said base include:

cooperative height adjustment means for selectively moving said case vertically within said base so as to adjust the height of said blade relative to the support surface; and further including:

sealing means between said guard and said base for preventing air passage therebetween.

* * * * *